US010724323B2

(12) United States Patent
Roseman et al.

(10) Patent No.: US 10,724,323 B2
(45) Date of Patent: Jul. 28, 2020

(54) DOWNHOLE VIBRATION TOOL FOR DRILL STRING

(71) Applicant: Ulterra Drilling Technologies, L.P., Fort Worth, TX (US)

(72) Inventors: Matthew B. Roseman, Fort Worth, TX (US); Christopher M. Casad, Benbrook, TX (US); Thomas A. Damian, Dallas, TX (US); Jason C. Maw, Beaumont Alberta (CA)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 45 days.

(21) Appl. No.: 15/999,267

(22) Filed: Aug. 17, 2018

(65) Prior Publication Data

US 2020/0056436 A1 Feb. 20, 2020

(51) Int. Cl.

| | |
|---|---|
| ***E21B 21/10*** | (2006.01) |
| ***E21B 31/00*** | (2006.01) |
| ***E21B 34/06*** | (2006.01) |

(52) U.S. Cl.

CPC ..... *E21B 31/005* (2013.01); *E21B 21/103* (2013.01); *E21B 34/06* (2013.01); *E21B 2200/06* (2020.05)

(58) Field of Classification Search

CPC ..... E21B 31/005
USPC ..... 166/177.6
See application file for complete search history.

(56) References Cited

U.S. PATENT DOCUMENTS

| | | | | |
|---|---|---|---|---|
| RE24,304 E * | 4/1957 | Boynton | ..... | E21B 34/14 417/111 |
| 4,298,077 A | 11/1981 | Emery | | |
| 6,237,701 B1 * | 5/2001 | Kolle | ..... | E21B 7/18 175/1 |
| 6,854,953 B2 * | 2/2005 | Van Drentham-Susman | ..... | E21B 4/02 175/107 |
| 2010/0224412 A1 * | 9/2010 | Allahar | ..... | E21B 7/24 175/55 |
| 2011/0083857 A1 | 4/2011 | Knobloch, Jr. et al. | | |

(Continued)

FOREIGN PATENT DOCUMENTS

| | | |
|---|---|---|
| WO | 2015109364 | 7/2015 |
| WO | 2017197442 | 11/2017 |

OTHER PUBLICATIONS

International Application No. PCT/US2019/046845, "International Search Report and Written Opinion", dated Nov. 27, 2019, 15 pages.

*Primary Examiner* — Taras P Bemko

(74) *Attorney, Agent, or Firm* — Kilpatrick Townsend & Stockton LLP

(57) ABSTRACT

A downhole tool for cyclically generating cyclical pressure waves in drilling fluids of sufficient magnitude to vibrate a drill string or coiled tubing to reduce friction between drill string or coiled tubing and a wall of an uncased or cased wellbore. A passageway through which drilling fluid flows through the tool is constricted to increase pressure of the drilling fluid while it continues to flow through the tool. A bypass around the constriction is cyclically opened by a rotary valve to increase the flow area through the tool for the drilling fluid while at the same time an axially shifting valve, shifted by a pair of rotating cams, opens to allow drilling fluid to vent to an annulus formed by the drill string or coiled tubing and a wall of the wellbore.

19 Claims, 9 Drawing Sheets

(56) References Cited

U.S. PATENT DOCUMENTS

| | | | | |
|---|---|---|---|---|
| 2013/0043021 | A1* | 2/2013 | Xu | E21B 28/00 166/177.6 |
| 2015/0354307 | A1 | 12/2015 | Baudoin | |
| 2017/0191325 | A1 | 7/2017 | Campbell | |
| 2018/0163495 | A1 | 6/2018 | Kinsella et al. | |
| 2018/0283122 | A1* | 10/2018 | Campbell | E21B 31/005 |

* cited by examiner 300
302
304
306
308
310
312
314
316
318
320
322a
322b
323
324
325
326
327
328
330
332a
332b
334
335
336
338
340
342

DOWNHOLE VIBRATION TOOL FOR DRILL STRING

FIELD OF INVENTION

The invention relates generally to downhole tools which vibrate a drill strings and coil tubing to reduce friction during oil and gas drilling and well workover operations.

BACKGROUND

Friction between a drill string or coiled tubing lowered into an open hole (uncased wellbore) or cased wellbore is a common problem in highly deviated or complex wells, such as horizontal wells, extended wells, and multi-lateral wells, which are formed using directional drilling techniques. The resulting drag impedes movement in and out of the hole of the pipe, as well as, in the case of drill strings, rotation of the drill string, especially once the drill string or coiled tubing stops moving and static friction takes over. When drilling a wellbore, the friction also affects the rate of penetration (ROP) of the drill bit. The full amount of the weight that the drilling operator is trying to put on the bit (the "weight on bit") is not being transferred to the bit when there is drag.

A "drill string" refers usually to the combination of jointed drill pipe, a drill bit, and other tools that is rotated from the surface to drill through subterranean rock formations to establish a wellbore for recovering deposits of oil and gas from the rock. However, coiled tubing can be used instead of jointed drill pipe to make up a drill string. In either case, drilling fluid or "mud" is pumped through the drill string under high pressure and then circulated back up to the surface through the annulus formed between the drill string and sides of the wellbore after it exits the face of the drill bit. The drilling fluid acts as a medium for evacuating rock cuttings. When a positive displacement or "mud" motor is placed within the drill string, the flow of drilling fluid also powers the mud motor.

Coiled tubing, which is a continuous pipe stored on reels that can be quickly moved in and out of wellbores, can also be used for different applications, such fishing operations, clean outs, operating downhole equipment (such as shiftable sleeves) and in other types of completion and work over operations. Both types of uses of coiled tubing can suffer from the problems associated with friction noted above. A reference to "drill string" is therefore intended to include drill strings that use jointed pipe or coiled tubing for drilling, as well as use of coiled tubing in other applications involving highly deviated or complex wells.

To reduce the effects of friction specialized downhole tools are inserted into the drill string for vibrating it. One well-known example of such a tool is the Agitator™ sold by NOV. Another example is "The Toe Tapper™" from CT Energy. Although some of these types of tools generate lateral and torsional vibrations, most generate axial oscillations in the drill string. The vibrations in the drill string help to reduce the effects of friction by generating cyclical pressure waves within the drilling fluid. Examples of these types of downhole tools are disclosed in U.S. Pat. Nos. 6,237,701, 6,431,294, 8,162,078 and 9,222,312, and U.S. published patent application number 2017/0191325.

SUMMARY

The claimed subject matter relates to improvements to downhole tools for generating a pressure wave in a fluid such as drilling fluid being pumped under high pressure through a drill string that is lowered into an open hole or cased wellbore. The pressure wave propagates through the fluid and is of sufficient amplitude to vibrate the drill string in order to reduce friction between the drill string and the sides of the wellbore when the wellbore is deviated. The downhole tool may be used with a shock tool or hammer assembly. Representative examples of different types and designs of vibration tools, each embodying one or more various improvements, are briefly summarized in this section with the understanding that summary is not intended to limit the scope of appended claims.

In one embodiment of such a downhole tool, the tool restricts the flow area of fluid through the tool to increase pressure and then widens the flow area and, at or near the same time, opens an external vent to allow fluid in the tool to escape into an annulus between the drill string and the sides of the wellbore in which it is being run, thus creating a sudden drop in pressure. Cyclically increasing pressure and then dropping it by increasing the flow area and externally venting the drilling fluid at the same time or nearly the same time increases the amplitude of the pressure wave while maintaining a drill string pressure (the pressure of fluid in the drill string seen by the pump or pumps at the surface) that is roughly an average between the highest and lowest pressure of the pressure wave. As compared to only venting or only varying the restriction of the tool to generate a pressure wave, the tool is able to generate a pressure wave of higher amplitude at a given drill string pressure, while maintaining a constant flow rate of fluid through the drill string. Maintaining a constant flow rate is important in some applications. There is a limit on the pressure that pumps that are used to pump drilling fluid are able to achieve. Pressure waves in the drilling fluid of greater amplitude tend to propagate further up the drill string, causing vibrations that are stronger and that extend further up the drill string, which should lead to less friction.

In one example of this embodiment, a passageway through which drilling fluid flows through the tool is constricted to increase pressure while still permitting the drilling fluid to flow through the tool. The flow area of drilling fluid through the tool is widened by opening a bypass around the constriction with one or more additional passageways, allowing drilling fluid to flow through both the constricted passageway and the bypass passageway(s). In another example, a valve opens a restriction bypass in synchronization with a separate valve that opens a drilling fluid vent to the annulus between the drill string and the wall of the wellbore (cased or uncased), which is at a lower pressure.

Another embodiment of such a downhole tool comprises an external vent for releasing drilling fluid into the annulus controlled with a valve that translates in a linear fashion along a direction generally parallel to of the axis of the tool to open and close the vent to the flow of drilling fluid. One, non-limiting example of such a valve is a sleeve that that is shifted axially to close and open (at least partially) an orifice comprising the external vent for communicating drilling fluid through the vent. An example of a mechanism by which the sleeve is shifted is a pair of rotating cams placed on opposite ends of the sleeve that cooperate to slide the sleeve axially between two positions. The cams are rotated by, for example, a downhole mud motor, but other sources of rotation may be used. In an example illustrated and described below, the cams are mounted on a hollow shaft that is rotated, through which the drilling fluid flows through the tool and to the external vent when opened by the shifting sleeve. An inline restriction may also be used to increase the pressure within the tool before opening the event. An advantage of the cams is that the pressure wave generated by the tool can be squared off by adjusting the period of time during which the vent is open, partially open/closed, and closed. Making the pressure more like a square wave than a sinusoidal wave increases the amount of energy in the wave, which will tend to increase the intensity or amplitude of vibration of the drill string.

In another representative embodiment, the downhole tool creates a cyclical pressure wave by operating a rotating valve to restrict cyclically a cross-sectional flow area for drilling fluid passing through the tool in coordination with cyclically reciprocating a linear valve controlling opening of a vent for diverting a portion of the drilling fluid into the annulus. The timing of the opening of the linear valve and the rotary valve may be adjusted so that the releases occur simultaneously or so that the releases occur at different timings, depending on the intensity and frequency of pressure waves needed for the application.

Described below, in reference to the non-limiting, representative examples illustrated into the accompanying figures, are these and other of embodiments of downhole tools employing one or more of the various improvements and their respective advantages.

DETAILED DESCRIPTION OF EXEMPLARY EMBODIMENTS

In the following description, like numbers refer to like elements. Furthermore, the following terms, when used in the summary, detailed description, and claims, are intended to have the following meanings unless the context plainly indicates otherwise. "Wellbore" means either an open hole (uncased) or cased bore hole that has been drilled for exploration or production of oil and/or gas. If cased, the wall of the wellbore is to the inside wall of the casing; if open hole, the wall is the side of the bore hole. References to "drill string" encompass drill strings made up of coiled tubing for drilling as well as coiled tubing used for other operations unless coiled tubing is specifically excluded. "Drilling fluid" is intended also to encompass any type of liquid being pumped under high pressure through jointed pipe or coiled tubing that has been lowered into a wellbore, even if it is not being used to drill. "Pipe" refers to both jointed and coiled tubing that is being used to drill a wellbore or to perform another type of operation within a wellbore. "Annulus" refers to the space between the pipe (drill string or coiled tubing) that is being run and the sides of the opening in which it is being run, for example the sides of uncased wellbore or, if cased, the inside wall of the well casing. Also, unless otherwise expressly stated, or the context clearly indicates otherwise, "open" is intended to be a relative term. It does not necessarily imply or require that an orifice or valve seat is completely open or unblocked. Similarly, "closed" is also intended as a relative term and means, within the given context, a closing of an orifice or valve sufficiently to achieve the stated result or purpose. It does not mean necessarily sealed.

Figure 1:
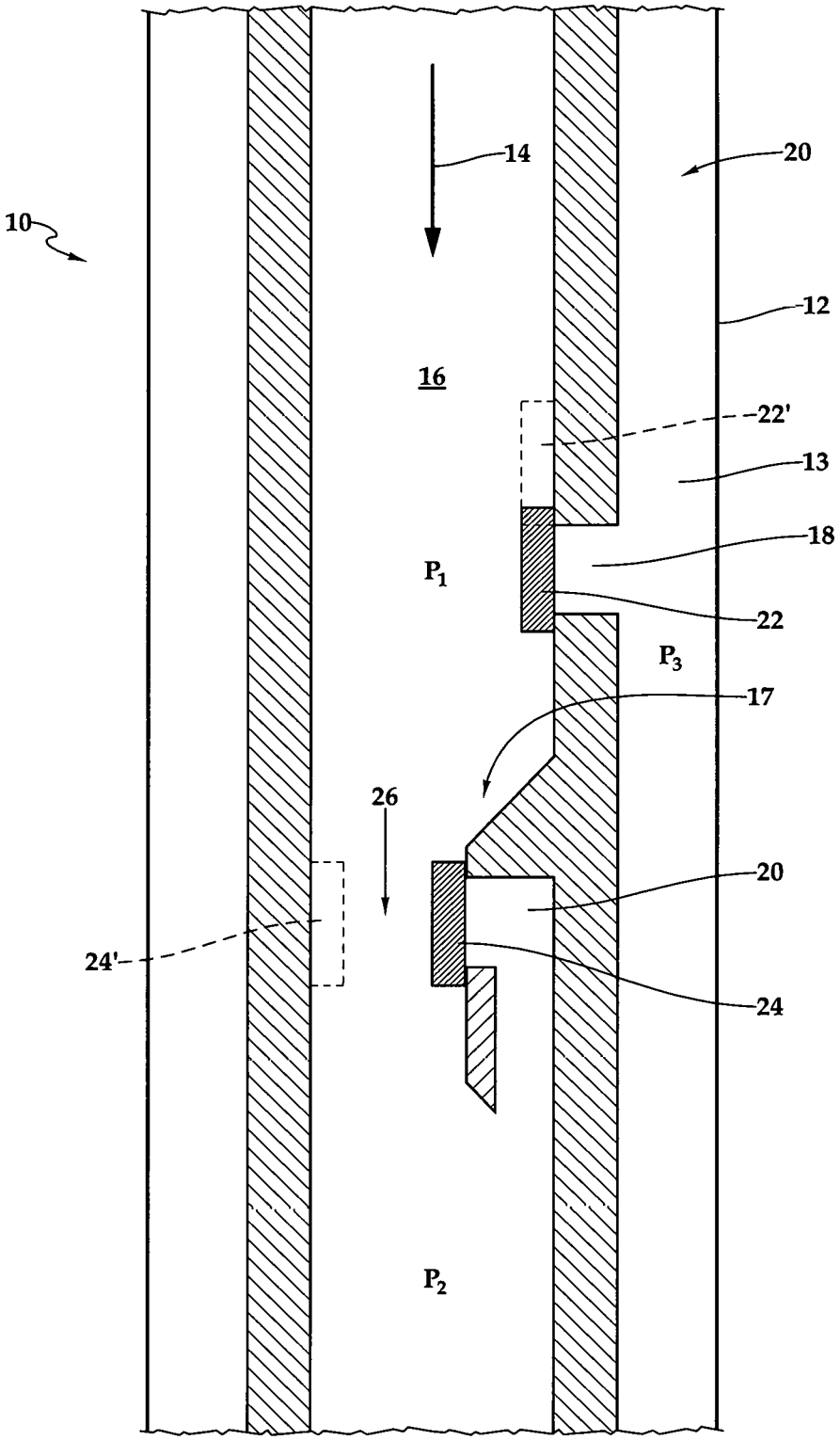
FIG. 1 schematically illustrates principles for operation of an embodiment of a downhole tool for generating pressure waves of sufficient magnitude in drilling fluid for vibrating a drill string.

FIG. 1 illustrates in a schematic fashion an anti-friction tool 10 having a tubular shape, connected into a drill string or coiled tubing (not shown) that has been lowered into a wellbore 12, which can be either cased or uncased. Drilling fluid is being pumped from the surface to a bottom hole assembly (not shown), where it exits and returns to the surface through an annulus 13 between the drill string or coiled tubing and the wall of thewellbore for circulating drilling fluid back to the surface. The tool is used to generate cyclical pressure waves within drilling fluid, represented by arrow 14, being pumped through the drill string or coiled tubing. The tool is capable of generating cyclical pressure waves with a magnitude, as measured by the difference between the highest pressure and the lowest pressure, sufficient to cause vibration of the drill string or coiled tubing.

In the illustrated embodiment, the tool has one or more one internal passageways that are collectively represented by passageway 16, through which drilling fluid is communicated from one end of the tool to the other end of the tool. References herein to "passageway" should be interpreted, unless the context plainly indicates otherwise, to collectively refer to one or more channels, conduits, or other type of pathway for drilling to flow. The tool 10 also comprises at least one constriction 17, or flow restriction, that narrows the effective cross-sectional flow area of drilling fluid flowing through the tool as compared to the cross-sectional flow area upstream. The purpose of the constriction is to build or increase the pressure $P_1$ of the drilling fluid within the tool upstream from the constriction. The tool further comprises at least one opening 18 in its exterior housing or side wall that, when opened, allows drilling fluid to be communicated from the passageway 16 to exterior of the tool, in the annulus. The at least one opening 18 comprises an external vent. The pressure of fluids within the annulus $P_3$ is typically much lower than the pressure of the drilling fluid $P_1$. The tool also comprises at least one channel 20 that allows drilling fluid to also flow around the constriction when the channel is open. The at least one channel acts as an internal bypass of constriction and enlarges the effective cross-sectional flow area for drilling flowing through the tool 10.

The vent orifice 18 and the bypass channel 20 are each closed at or near the same time to increase pressure $P_1$ in the drilling fluid upstream of the constriction 17 while still allowing the drilling fluid to flow downhole through the tool. At this point the pressure $P_1$ of the drilling fluid upstream of the constriction is greater than pressure $P_2$ of the drilling fluid downstream of the constriction within the tool and pressure $P_3$ in the annulus 13. When the vent and the bypass channel are opened at or near the same time, pressure $P_1$ will suddenly drop toward pressure $P_2$ due to a portion of the drilling fluid being diverted externally into annulus 13 and internally into the bypass channel. The drilling fluid flowing through the bypass channel converges with drilling fluid passing through the constriction 17 in a portion of the passageway 16 that has the same or larger cross-sectional area than the combined cross-sectional areas of the bypass channel and constriction opening 26. The vent and bypass are cyclically opened and closed to generate a pressure waves with a high pressure point that is higher than pressure of the fluid in the drill string (drill string pressure) seen by pumps at the surface, and a low pressure point that is lower than the drill string pressure, that will create an axial vibration in the drill string or coiled tubing and that can be coupled with a hammer or shock sub (not shown) to vibrate the drill string or coiled tubing. The amplitude of the pressure wave, which is the difference between the highest pressure generated during the tool's closed state, and the lowest pressure, generated when the tool is in the open state, is much greater for the given drill string pressure than can be achieved with just opening and closing the vent or just opening and closing the bypass.

The flow rate of the drilling fluid through the tools stays relatively constant during the cycling of the vent and bypass in both open and closed states except for a small loss in drilling fluid through the vent. The size of the constriction 17 is kept, in one embodiment, constant at least during the cycling of the vent and bypass to help to maintain a relatively steady flow rate of drilling fluid through the tool. Downstream tools may require or benefit from a steady flow rate. The constriction could be made and assembled in manner that allows for its diameter or area of its opening to be changed during set up of the tool. This would allow the same tool to be adapted for different runs. The tool could also be constructed to allow for the size of the constriction to be changed when it is downhole.

Figure 2A:
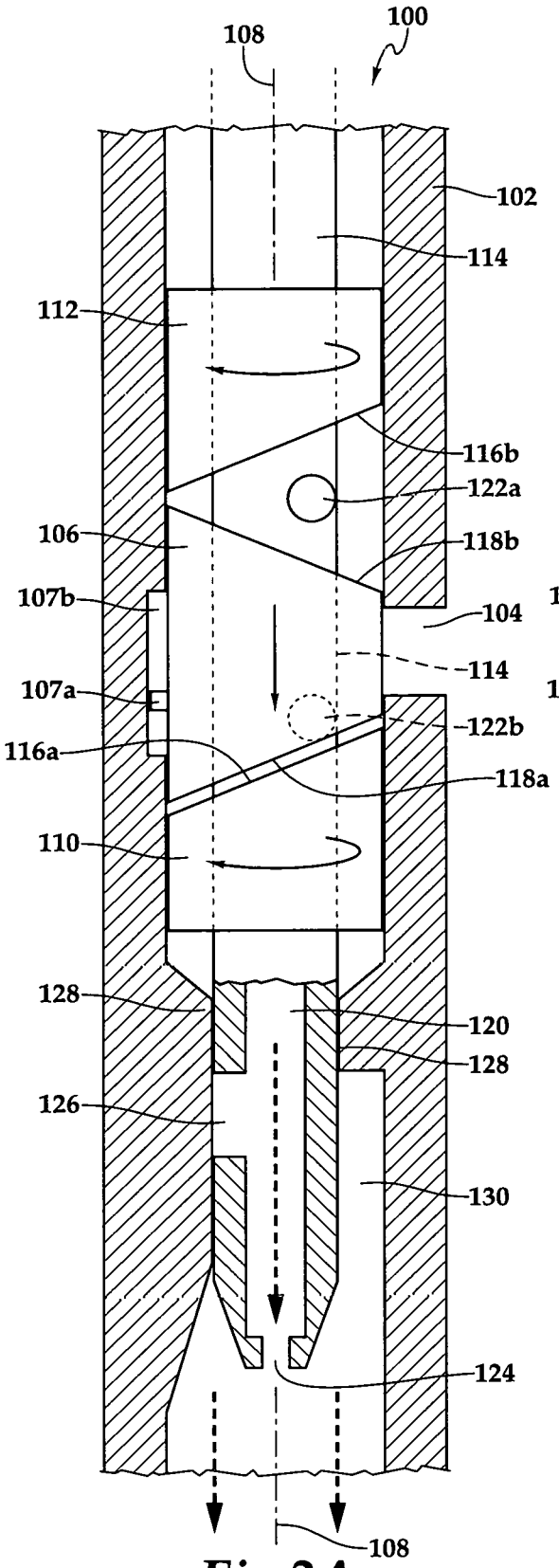
FIGS. 2A and 2B are a schematic cross-section of an embodiment of a downhole tool in a closed and an open state, respectively, for creating pressure waves in drilling fluid according to the principles illustrated by FIG. 1.
Figure 2B:
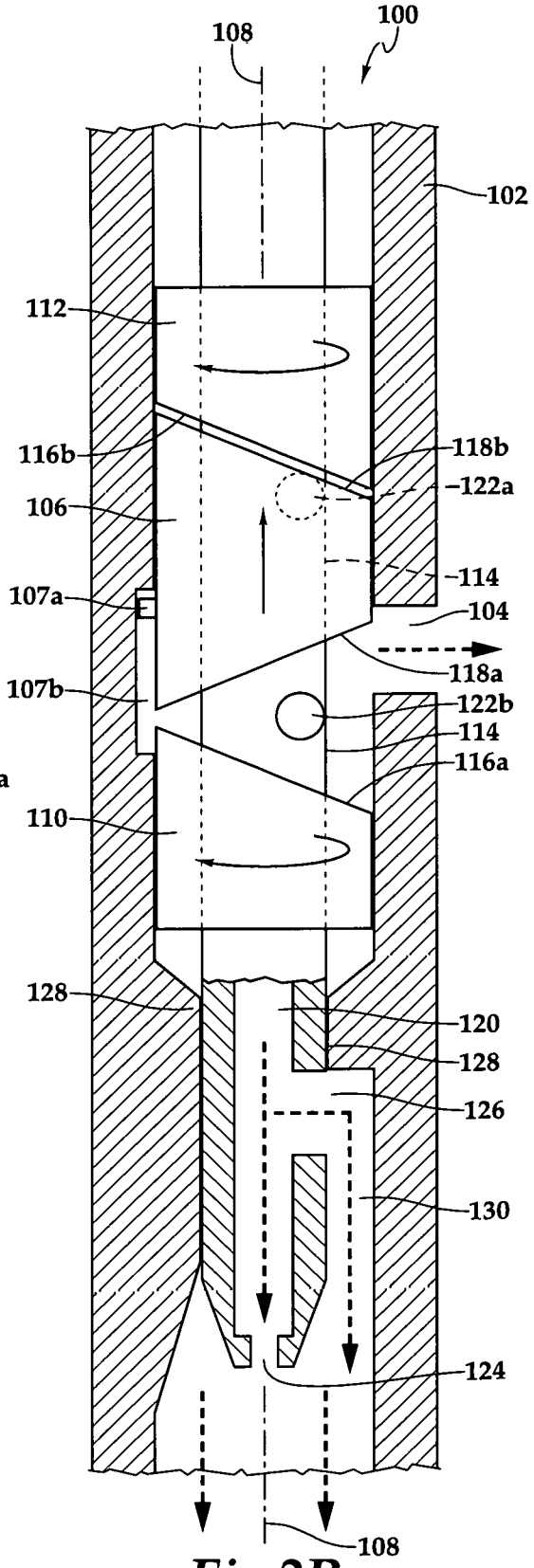

The vent 18 is intended to be representative of one or more orifices (only one is shown) defined in an exterior wall or housing of the anti-friction tool 10. In this embodiment, fluid flow through the vent is controlled by a valve that translates within the tool axially, meaning that it moves linearly along the direction of the central axis of the tool (and drill string or coiled tubing). This valve is identified in FIG. 1 by reference number 22 when in a closed position, where it mostly or entirely blocks or prevents drilling fluid from flowing through the vent, it through the vent. The valve in its open position is represented by dashed lines and referenced by number 22'. A second valve 24, which is indicated as being a rotary valve, opens and closes the bypass channel 18 to the flow of drilling fluid. It is indicated or represented in its closed position in solid lines, referenced by number 24, and its open position in dashed lines, referenced by number 24'. In this embodiment, the valve is indicated as being a rotary valve that rotates about an axis parallel to the central axis of the tool. Although use of axially reciprocating and rotary valves in this fashion can have certain advantages, which will be apparent from the discussion below, an alternative embodiment may substitute a rotary valve for an axial valve 22 or an axial valve for a rotary valve 24. In other alternative embodiments, both substitutions may be made FIGS. 2A and 2B are schematic illustrations of an embodiment of an anti-friction vibration tool 100 constructed to operate according to FIG. 1. The tool includes an internal restriction on the flow of the drilling fluid in the tool to increase pressure, and an external vent and an internal bypass that are operated, respectively, by axial and rotary valves, to cyclically decrease the pressure of the drilling fluid within the tool to generate a pressure wave of sufficient amplitude to vibrate a drill string or coiled tubing to reduce friction. In FIG. 2A, the vent and bypass are closed. In FIG. 2B the vent and bypass are open.

The tool in this embodiment has a housing 102, in which is defined an opening to the exterior of the tool that comprises a vent 104 for communicating drilling fluid flowing through the tool to the annulus. An axially reciprocating valve opens and closes the vent. In this example the axially reciprocating valve is comprised of a sleeve 106 that translates within the housing of the tool in an axial direction between a closed position, shown in FIG. 2A, in which it closes the vent, and an open position, shown in FIG. 2B. The sleeve is prevented from rotating with respect to the housing. In this example, it is prevented from rotating by a key 107*a* and complementary keyway 107*b* that allows for translational movement along the central axis of the sleeve but prevents rotation with respect to the housing. However, other arrangements can be used to prevent rotation while allowing translation. Although the sleeve is coaxial with the center axis 108 of the tool in this example, it can be an axially reciprocating sleeve without being coaxial. In other embodiments, its central axis can be offset.

The sleeve is reciprocated between open and closed positions by a pair of cams 110 and 112 disposed on opposite ends of the sleeve 106. The cams are mounted on a shaft 114 so that they rotate with the shaft. The shaft is turned by a motor (not shown). The motor can be a positive displacement motor, turbine or other type of motor powered by the flow of drilling fluid. However, other types of motors could also be used. An end on each of the cams 110 and 112 has an axially eccentric cam surface 116*a* and 116*b*, respectively. In this example, each cam surface is represented as an end surface that is inclined with respect to the axis along which sleeve 106 reciprocates. The cams are, in this example, mounted on the shaft so that their eccentricities are rotationally 180 degrees apart. When the cams are rotated, the eccentric portions of the cam surfaces (the portion which extends further) take turns pushing the sleeve, with the result that the sleeve reciprocates back and forth. Each end surface 118*a* and 118*b* of the sleeve acts as a cam follower that engages, respectively, the cam surfaces 116*a* and 116*b*. However, the end surfaces 118*a* and 118*b* are also shaped to accommodate the eccentric portions of cam surfaces 116*a* and 116*b*, respectively, when that cam is not pushing the sleeve. This is indicated schematically in this example, by end surfaces 118*a* and 118*b* of the sleeve having an angle with respect to the sleeve's axis that complements the angle of the respective cam surfaces 116*a* and 116*b*.

The operation of the cams can be appreciated by comparing FIGS. 2A and 2B. In FIG. 2A the eccentricity of cam surface 116*b* on cam 112 has acted against the end surface 118*b* of the sleeve to push the sleeve 106 to a position where it closes vent 104, and cam 110 has rotated so that its cam surface 116*a* accommodates the end surface 118*a* of the sleeve. As the shaft 114 continues to rotate, as shown in FIG. 2B, the cam surface 116*a* has pushed the sleeve back to a position in which vent 104 is open.

The shaft 114 is hollow and defines a conduit 120 that forms a portion of the drilling fluid passageway through the tool that communicates drilling fluid from an upstream end that connects the drill string or coiled tubing to a downstream end that connects to a lower portion of the drill string or other subassembly below the tool. The dashed arrows in the figures indicate generally the flow of drilling fluid through the tool. The shaft 114 may have at least one opening not blocked by the sleeve 106 as its shifts back and forth, through which drilling fluid is always able to flow into an area between the shaft and the housing 102 and then out through the vent 104 when it opens. In this example, two, axially and rotationally displaced orifices 122*a* and 122*b* can be seen, one when the vent is open and one when the vent is closed. This ensures that drilling fluid is always available for flowing through the vent when it is open. Instead of multiple, round orifices, one or more elongated orifices or slots could be used.

In this embodiment, the tool 100 includes a narrowing of the passageway for the drilling fluid—a constriction—that reduces the cross-section area through which the drilling fluid may flow through the tool to increase pressure of the drilling fluid passing through the tool. In this example, the constriction is formed by exit opening 124 at the end of the shaft 114 that has a smaller cross-sectional area than the cross-sectional area of the conduit 120. Given that the conduit is round in this example, the diameter of the exit opening is smaller than the internal diameter of the conduit. The shaft also has defined in it a bypass orifice 126 that allows for communication of drilling fluid from inside the shaft to outside the shaft. A shoulder 128 extends inwardly from the housing to meet the shaft and at least partially surrounds it to close the bypass orifice when the shaft is in a position in which the sleeve 106 closes the vent 104, as shown in FIG. 2B. However, when the shaft is rotated to a position shown in FIG. 2B, in which the vent 104 is open, the bypass orifice is aligned with bypass channel 130. Drilling fluid thus may flow into the bypass channel at the same time some of it is vented, thus quickly decreasing the pressure of the drilling fluid within the conduit 120. In this example, the bypass channel is defined by the shaft 114, an interior wall of the tool, and the shoulder 128. However, it could be defined in other ways. The shaft, bypass opening, shoulder and bypass channel form a rotary valve for cyclically enlarging the flow area for the drilling fluid through the tool.

Figure 3:
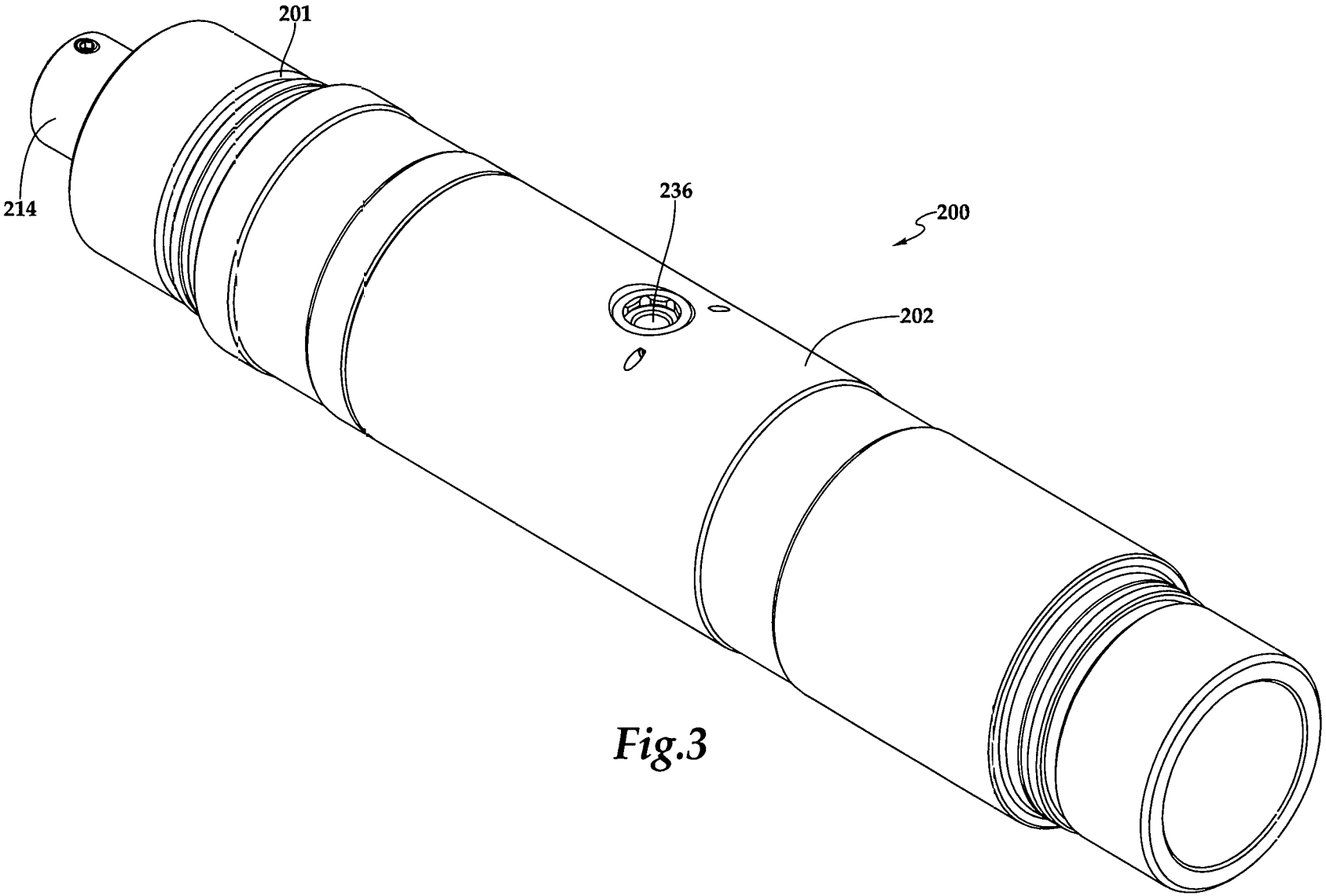
FIG. 3 is a perspective view of an embodiment of a downhole, vibration tool capable of generated pressure waves sufficient to vibrate a drill string.

Turning now to FIG. 3, FIGS. 4A-4D, FIGS. 5A-5D, and FIGS. 6A-6D, which illustrate a specific example of a downhole, anti-friction tool 200 like tool 100 in FIGS. 2A and 2B. FIG. 3 is a perspective view of the complete tool 200. FIGS. 4A-4D are cross-sections of tool 200 taken along the central axis of the tool when an external vent and internal bypass are in, respectively, closed, half-open, open, and half-closed positions. FIGS. 5A-5D are cross-sections taken across the central axis of the tool as indicated in FIGS. 4A-4D, respectively. FIGS. 6A-6D show the tool with its exterior housing removed to reveal the positions of the internal components of the tool 200 in, respectively, closed, half-open, open and half-closed positions.

Tool 200 is designed as a sub for a drill string or coiled tubing, with an exterior, tubular-shaped housing having couplings 201 and 203 at each end. Drilling fluid enters the tool through opening 204 and exits though opening 206. When it enters the tool, drilling fluid flows into openings 208 in hollow shaft 210. The hollow shaft defines a conduit 212 that comprises a passageway through the tool for communicating drilling fluid between the entrance and exit openings 204 and 206. One end of the shaft includes a coupling 214 for connecting with the output shaft of a motor, such as a positive displacement or "mud" motor (PDM), which is not shown, that can be connected to coupling 201. The opposite end of the shaft terminates with a constriction 216 with an exit opening 218 that has a smaller flow area than the conduit 212. The shaft is supported for rotation within the tool by a radial bearing 220, held between shoulders 222 and 224, and a bearing 226 between a collar 228 on the shaft and a shoulder 230 extending from the inside of the housing that acts as both a radial and an axial or thrust bearing.

Figure 4A:
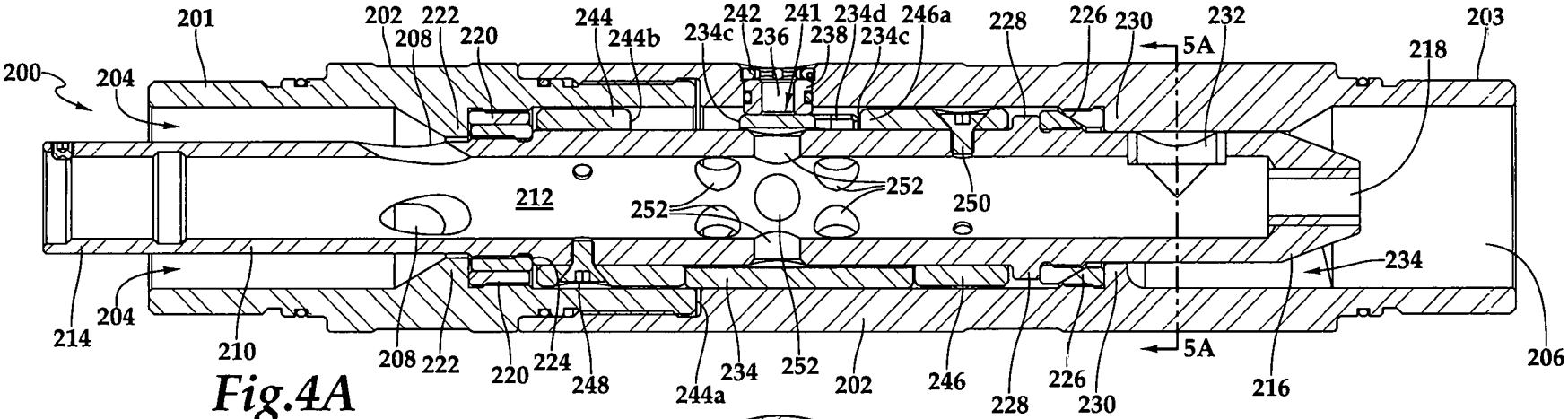
FIGS. 4A, 4B, 4C and 4D are cross-sections of the tool shown in FIG. 3, taken along its centerline, when the tool is, respectively, a closed state, a half-open state, an open state, and a half-closed state.
Figure 5A:
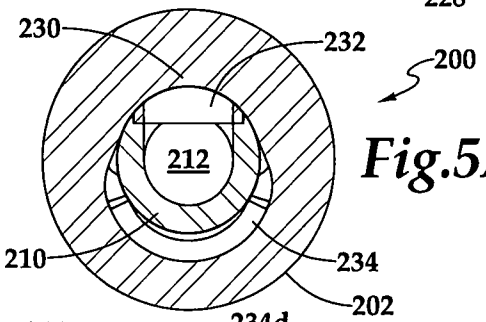
FIGS. 5A, 5B, 5C and 5D are cross-sections of the tool shown in FIG. 3, taken across its centerline when the tool is, respectively, a closed state, a half-open state, an open state, and a half-closed state, as indicated, respectively, in FIGS. 4A, 4B, 4C and 4D.
Figure 6A:
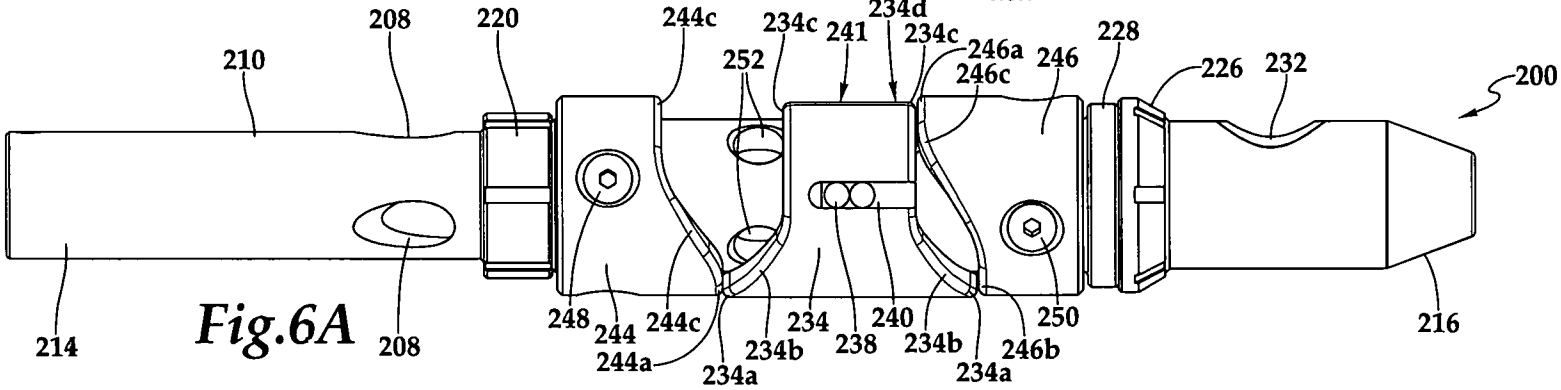
FIGS. 6A, 6B, 6C, and 6D show the tool of FIG. 3 without its housing in, respectively, a closed state, a half-open state, an open state, and a half-closed state.
Figure 4B:
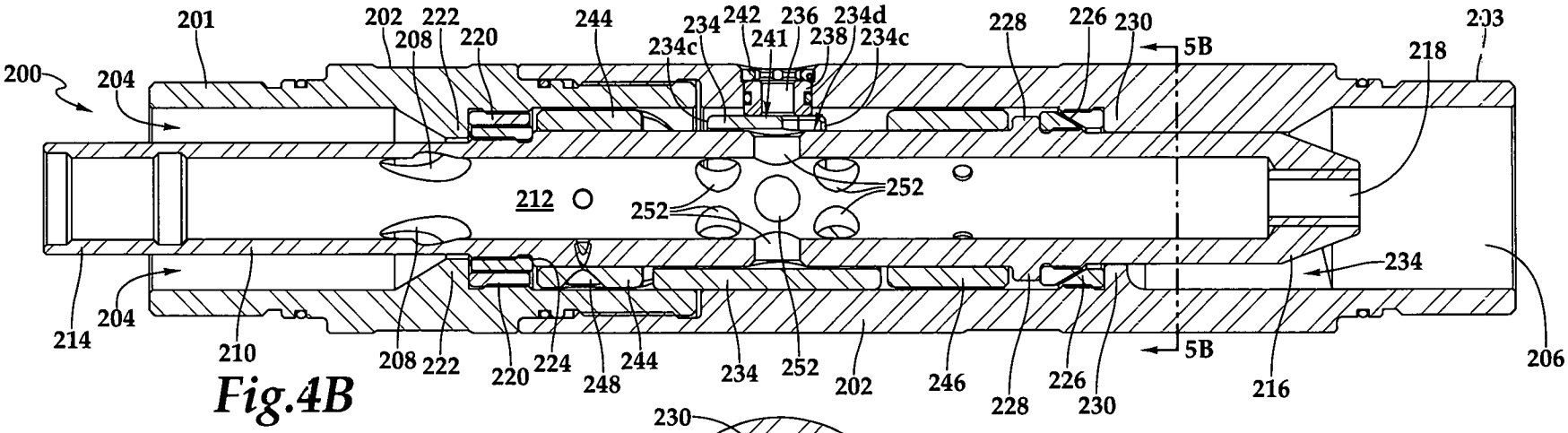
Figure 5B:
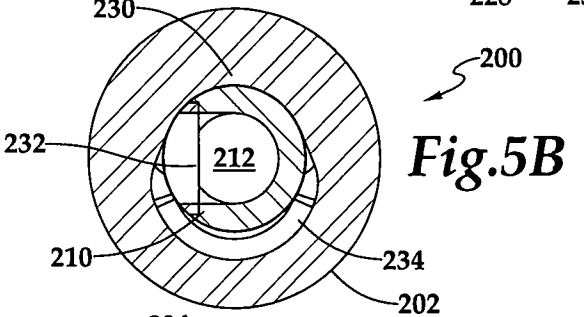
Figure 6B:
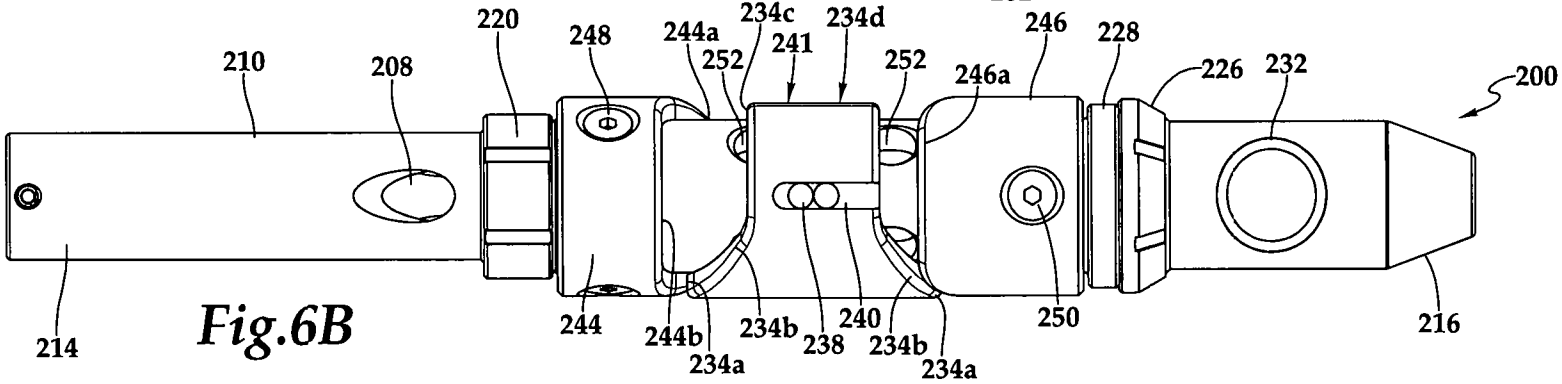

The shaft 210 includes a bypass orifice 232 that, when tool the shaft is in a closed position as shown in FIGS. 4A, 5A, and 6A, is blocked or closed by the shoulder 230. As it rotates to an open position, shown in FIGS. 4C, 5C, 6C, the bypass orifice is fully aligned with bypass channel 234. In FIGS. 4B, 5B, and 6B, when shaft is rotated to a half-open position, and in FIGS. 4D, 5D, and 6D, when the shaft is rotated to a half-closed position, the bypass orifice is partly open. The width of the bypass channel and bypass orifice determines when the bypass orifice is open and for how long its stays open.

Sleeve 234 shifts axially to open and close vent orifice 236. Balls 238 act as a key and slots 240 with corresponding slots in the interior wall of the housing 202 form keyway for preventing the sleeve from rotating with respect to the housing 202. A second set of balls and slots are on located the opposite side of the sleeve. Any number of sets of slots and balls can be used, and/or other types of means for preventing rotation can be used. The vent orifice 236 includes a seat 238 that contacts a flat surface 241 on top of the sleeve as the sleeve shifts axially. This helps to seal the vent when it is closed by the sleeve. The seat is inserted into a hole formed in the housing 202 and held in placed by ring 242.

A pair of cams 244 and 246 that are attached to the shaft 210 by screws 248 and 250 and thus rotate with the shaft. An end of each of the cams 244 and 246 that faces the sleeve forms a cam surface with cam profiles that comprises an axially eccentric portion 244*a* and 246*a*, respectively, a least-eccentric portion 244*b* and 246*b*, respectively, and transition portion 244*c* and 246*c*. The cam profiles are shaped to open and close the vent in a manner that creates a pressure wave in the drilling fluid. Each end of the sleeve 234 has a surface profile and shape that follows the eccentric end cam surfaces 244*a* and 246*a* as they rotate, the sleeve sliding as necessary to fit between the most eccentric portions of the cams. Rotation of the cams simultaneously results in one cam pushing or displacing the sleeve axially by a certain amount, while the other cam prevents the sleeve the sleeve from being pushed or displaced any further than that amount. The cams thus can precisely position the sleeve. As can be seen based in FIGS. 6A-6D, the ends of the sleeve are a mirror image of each other and form cam follower surfaces, the contour of which determine, along with the eccentric portions 244*a* and 246*a* of the cams, how long the sleeve remains in the open and closed positions and how quickly it transitions. Each of the cam follower surfaces of the sleeve 234 have an axially eccentric portion 234*a*, curved transition portion 234*b*, and a least-eccentric position 234*c*. When the vent is in a closed position as shown in FIGS. 4A, 5A and 6A, the eccentric the flat portions 234*a* are engaged by the eccentric cam surface portion 244*a* of cam 244 and the least-eccentric portion 246*b* of the cam surface of cam 246. The most eccentric portion 246*a* of the cam surface of cam 246 also engages the least-eccentric portion 234*c* of the cam follower surface of sleeve 234.

Figure 4C:
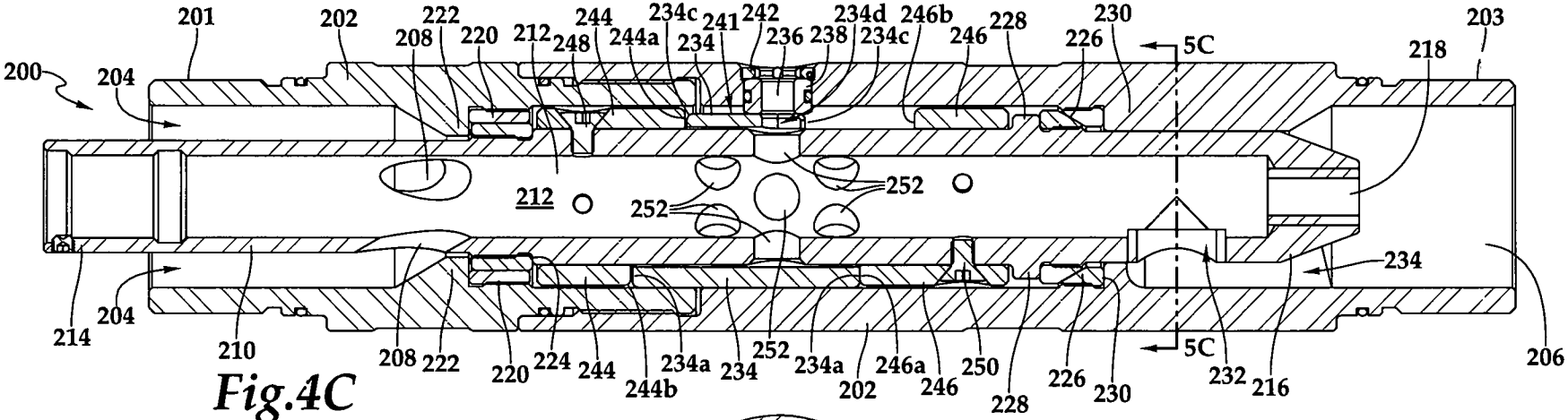
Figure 5C:
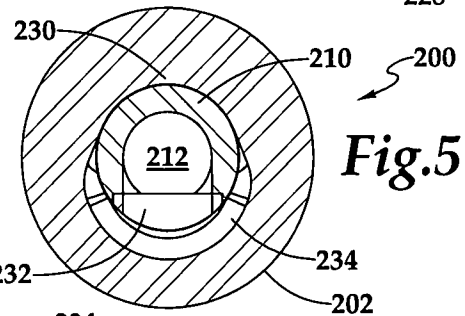
Figure 6C:
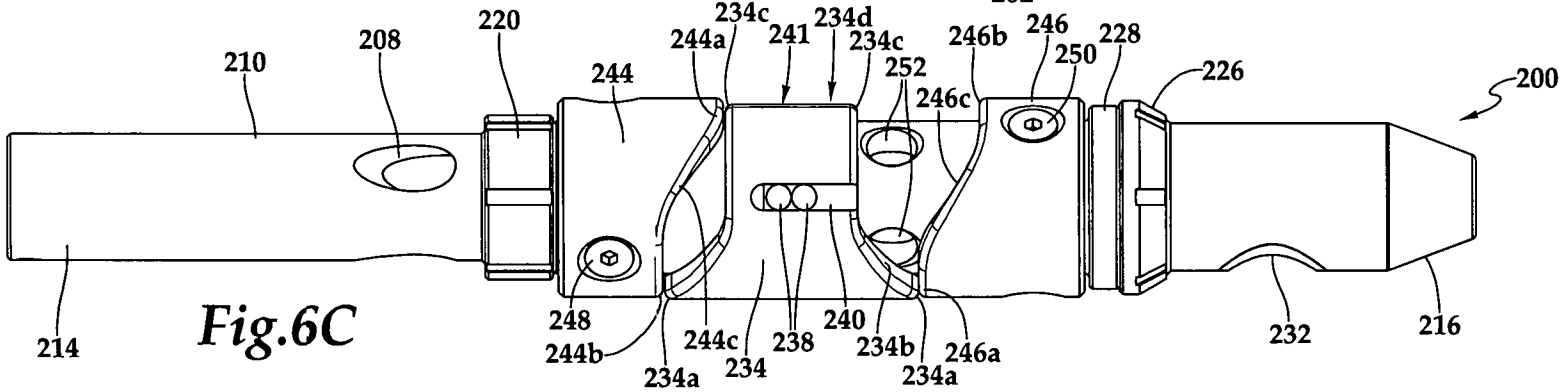
Figure 4D:
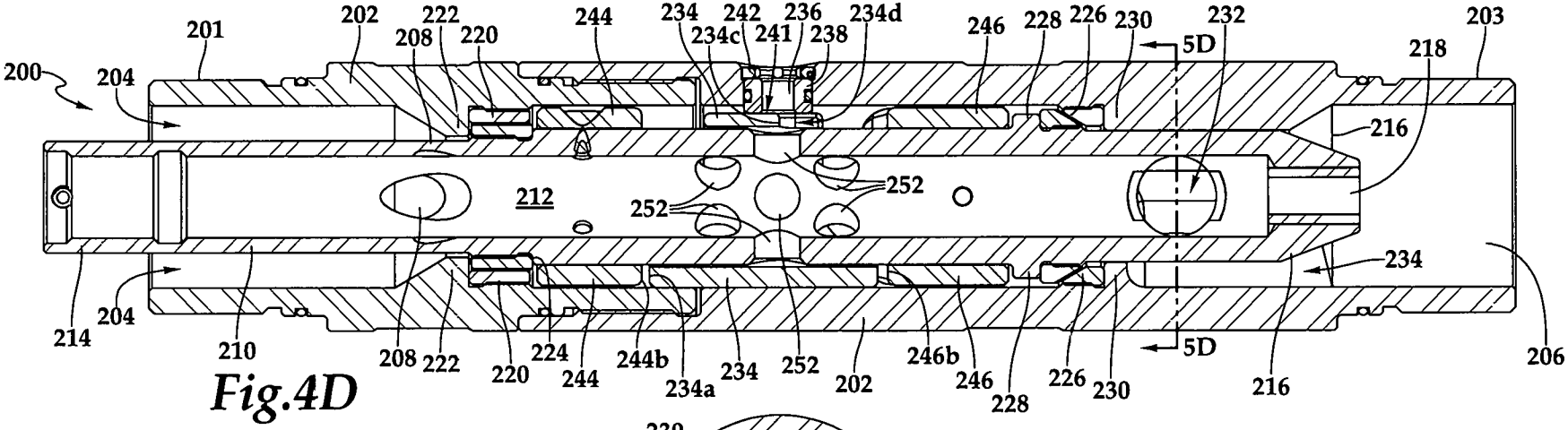
Figure 5D:
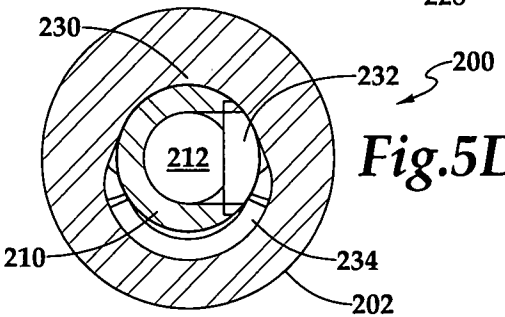
Figure 6D:
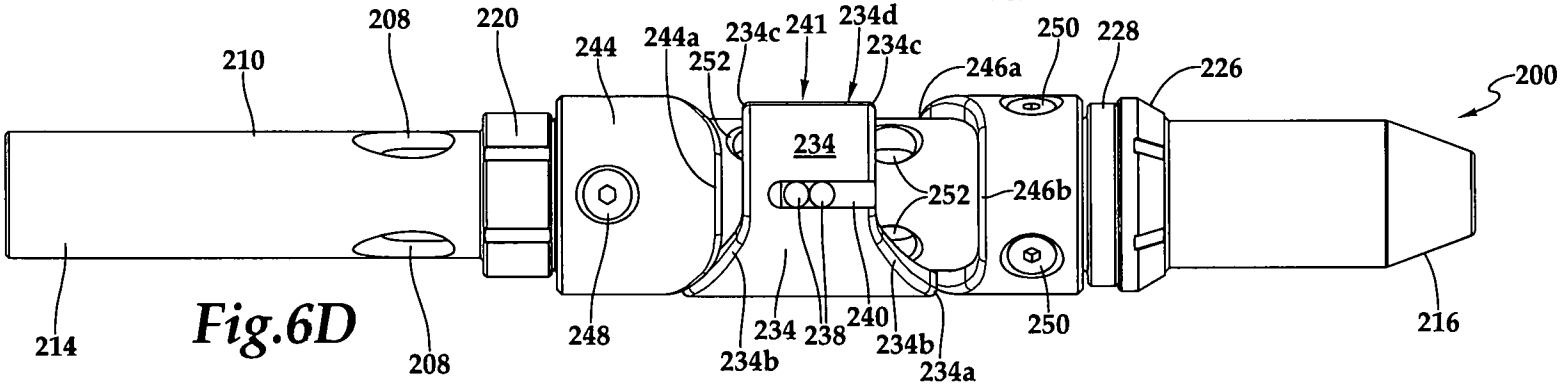

In FIGS. 4C, 5C, and 6C, which show the sleeve in an open position, this is reversed.

When the cams are rotated to displace the sleeve axially to half-open or half-closed positions, as shown by FIGS. 4B, 5B, and 6B, and FIGS. 4D, 5D, and 6D, the curved transitions 244*c* and 246*c* of the cam surfaces of cams 244 and 246 engage the curved transition portions 234*b* of the cam follower surface of the sleeve.

Sleeve 234 also has a slot 234*d* extending axially inward from one side of sleeve that opens the vent orifice 236 without having to move the sleeve a distance equal to its width at the top to fully uncover the vent orifice.

The shaft 210 has a plurality of orifices 252 for communicating drilling fluid from the conduit 212 into the space between the shaft 210 and inside of the housing 202. The openings are located so that at least one of the orifices is always open regardless of the position of the sleeve.

Figures 7, 8A, 8B:
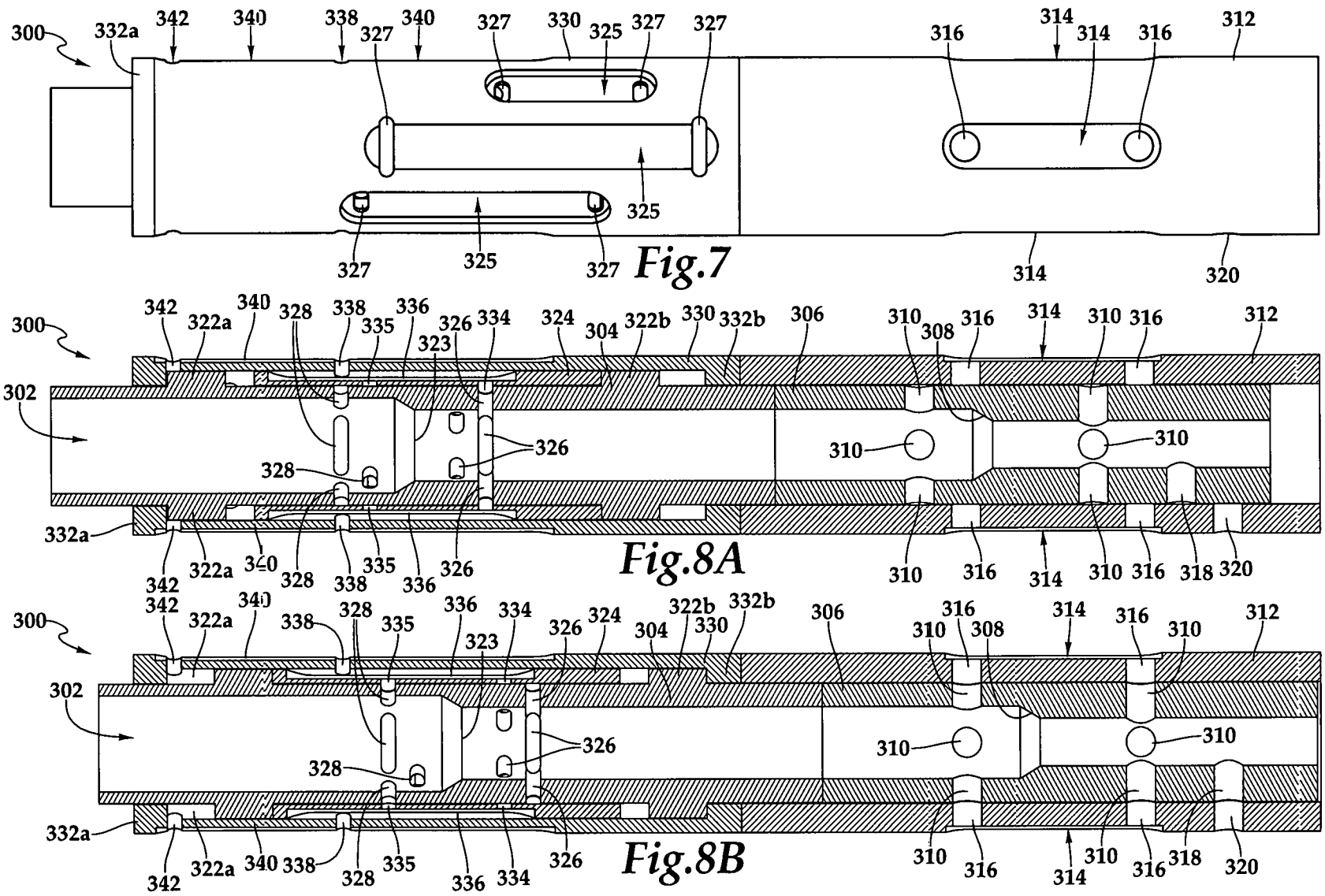
FIG. 7 is a side view of another embodiment of a downhole vibration tool capable of generating pressure waves sufficient to vibrate a drill string, without its housing.
FIGS. 8A and 8B are cross-sections of the downhole tool in FIG. 7 taken along is center line and viewed from the same angle as shown in FIG. 7, with the tool in a fully closed, high pressure state, and a fully open, low pressure state, respectively.

In alternative embodiments, an axial valve for an external vent of a downhole tool for creating pressures can be shifted or displaced using the pressure of the drilling fluid by creating pressure differentials across a sleeve or mandrill to shift it to open and close either or both an external vent and a bypass valve. FIGS. 7, 8A and 8B illustrate an example of such an embodiment, which uses a single mandrill to control both an internal bypass and an external vent and relies on the high pressure of the drilling fluid to move the mandrill in a reciprocating fashion.

How long the vent orifice remains fully open and fully closed is a function of the size of the vent opening, how long the vent opening is exposed by sleeve 234 (which is determined in part by the length of the slot 234*d*), how long it remains covered by the sleeve, and the profiles of the end surfaces 234 of sleeve 236 and for cams 244 and 266. In this illustrated example, the vent orifice remains fully open for about $\frac{1}{3}^{rd}$ of the cycle ($\frac{1}{3}^{rd}$ of a revolution or 120 degrees of rotation of the cams), and fully closed about ⅓ of the cycle, partly open for $\frac{1}{6}^{th}$ of the cycle and partly closed for $\frac{1}{6}^{th}$ of the cycle. This pattern allows the tool to generate of a pressure wave that is more of a square wave than a sinusoidal wave. However, the cam profiles, sleeve, and vent opening can be changed to achieve differently shaped pressure waves.

Turning now to FIGS. 7, 8A and 8B, downhole tool 300 is an example of an embodiment for creating pressure waves without a rotary input. The tool has a tubular-shaped outer housing that is not shown. A mandrill that is operable to be shifted axially and does not rotate extends through the center of the tool, along the tool's center axis. It has a hollow center 302, through which flows drilling fluid. The tool has two sections: one that uses the high pressure of the drilling fluid to create a reciprocating motion for shifting an upper mandrill 304, and a lower bypass mandrill 306 that connects to the upper mandrill so that it can be axially shifted. FIG. 8A shows the mandrill in a closed position, in which drilling fluid flowing through the mandrill cannot bypass a constriction 308 in the hollow center that generates backpressure on drilling fluid flowing through the tool. Furthermore, no drilling fluid can be diverted to the annulus through an external vent. FIG. 8B shows the mandrill in an open position in which drilling fluid can be communicated through the internal bypass, around the constriction 308, and simultaneously externally vent to drilling fluid into the annulus.

The bypass mandrill 306 includes a constriction 308 that narrows the flow area for the drilling fluid flowing through the mandrill. The bypass mandrill also implements an internal bypass of the constriction and an external vent that can be opened and closed by shifting the mandrill. Bypass ports 310 on opposite sides of the constriction will connect to an internal bypass formed through a stationary sleeve 312. The passageway for the internal bypass is defined by a depression or channel 314 formed in an outer circumference of the sleeve and the inner surface of the tool's housing (not shown). When aligned with the bypass ports 310 in the mandrill as shown in FIG. 8B, ports 316 communicate drilling fluid upstream from the constriction 308 to the bypass channels 314, and then back to hollow center 302 of the mandrill downstream of the constriction.

The bypass mandrill 306 also includes a vent port 318 that is blocked by sleeve 320 when the mandrill is in a closed position. When mandrill is shifted to an open position, it aligns with a vent port 320 in sleeve 312. Although not shown, vent port 320 connects with an orifice in the housing of the tool to communicate drilling fluid to the annulus.

To shift the mandrill 304, and thus also bypass mandrill 306, a pressure differential is created across collars 322*a* and 322*b* by switching passageways containing higher pressure and lower pressure drilling fluid to each side of a collar to create a pressure differential. High pressure and lower pressure drilling fluid is created by a constriction 323, with the drilling fluid upstream having a higher pressure than the drilling fluid downstream of the constriction. Ports 326 are located on the lower pressure side; ports 328 are located on the higher pressure side. Ports 326 supply lower pressure drilling fluid; higher pressure ports 328 supply higher pressure drilling fluid.

A sliding sleeve 324 selectively couples different higher and lower pressure passageways to each side of each collar depending on the position of the mandrill. The passageways are comprised of a series of channels, generally designated 325, and ports, generally designated 327, formed in stationary sleeve 330, which can be seen on FIG. 7, and in the valve sleeve 324, some of which can be seen in FIGS. 8A and 8B.

For the mandrill to have been be shifted left or upstream as shown in FIG. 8A, high pressure passageways would have been connected to the downstream or right side of collars 322*a* and 322*b*, such as in the volume between collar 322*b* and shoulder 332*b*, and lower pressure passageways would have to have been coupled with the left side or upstream sides of the collars. During this, valve sleeve 324 will have been shifted to the right.

Taking channel 336 as an example, of how the valve switches the higher and lower pressure couples, FIG. 8A shows that that the channel has an opening 334 that is aligned with lower pressure port 326. Channel 336, which is formed within the valve sleeve 324 and is bounded on one side by an inner wall of the stationary sleeve 330, is a channel that forms part of a passageway to upstream stream side of collar 322*a*. Thus, the upstream side of collar 322*a* (the left side in the figure) will have been at a lower pressure, which allowed the mandrill to be shifted by the higher pressure drilling fluid on the downstream (right on the figure) side of collars 322*a* and 322*b*. The communication of the pressure in channel 336 is communicated through port 338 to a channel 340 that is formed in the sleeve 330 and bounded on one side by the tool housing (not shown). A mirror image of this arrangement is on the other side of the mandrel and the same reference numbers are used to designate it.

When the mandrill and valve slide to the left, other channels, which cannot be seen in FIGS. 8A and 8B, open to couple the volume between the valve sleeve 324 and the collar 322*a* to lower pressure drilling fluid to allow the valve sleeve 324 to shift left, as well as to couple the volume to the right of the collar 322*b*, between it and shoulder 332*b*, to lower pressure drilling fluid to allow the mandrill to be shifted downstream. At the same time, another channel (not visible in these views) opens to couple higher pressure fluid to the volume between the downstream side of the valve sleeve 324 and collar 322*b* to cause the valve sleeve 324 to shift to the left to align one of the mandrill's high pressure ports 328 to opening 328 to channel 335, as shown in FIG. 8B. This couples higher pressure drilling fluid to channel 340 and then to the volume between the shoulder 332*a* and collar 322*a*. The higher pressure on the left side of the collar 322*a* causes the mandrill to shift downstream into the position shown in FIG. 8B. The foregoing process is reversed once it is in the position shown in FIG. 8B.

In an alternative embodiment, the tool can be adopted by reverse the two halves of it, so that the lower portion of the tool comprising sleeve 312 and bypass mandrel 306 that acts to constrict fluid flow to build pressure and release it, is located upstream of the tool that is comprised sleeve 330, shifting mandrel 304 and the other components that act to shift the mandrel 306.

In an alternative embodiment, the bypass mandrill 306 section of the tool could be adapted to be axially shifted by a means other than the reciprocating shifting mechanism powered by the pressure of the drilling fluid, including by other types of self-oscillating or self-reciprocating shifters powered by use pressure differentials, as well as mechanisms that convert rotational motion to reciprocating axial translation, such a cams that are rotated by a PDM, turbine or other type of rotary power source. A cam mechanism on only the upstream side of the mandrill could be used to push and then pull the mandrill as it rotates. A self-oscillating shifter that uses the high pressure drilling fluid, like the one described above, could also substitute for a cam or other mechanism to shift an axial valve, such as the sleeve shown in the preceding figures, to open and close an external vent.

Figure 9A:
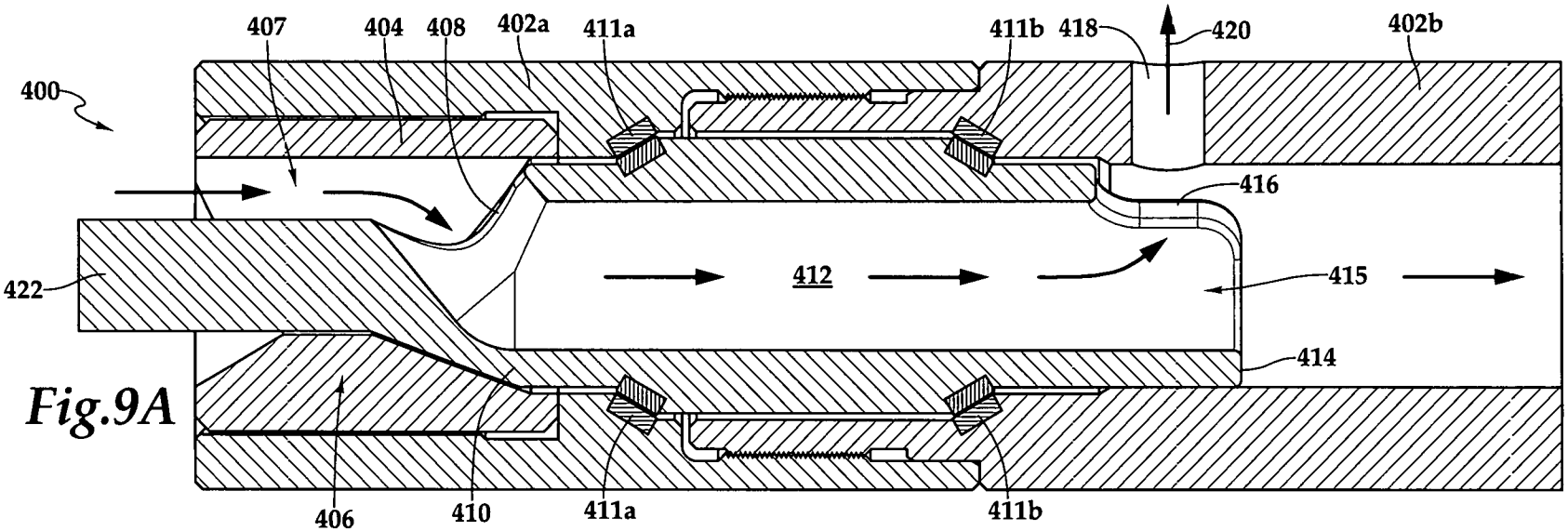
FIGS. 9A and 9B are cross-sections of yet another exemplary embodiment of a downhole vibration tool capable of generating a cyclical pressure wave of sufficient magnitude to vibrate a drill string in a fully open, low-pressure state and a fully closed, high pressure state, respectively.
Figure 9B:
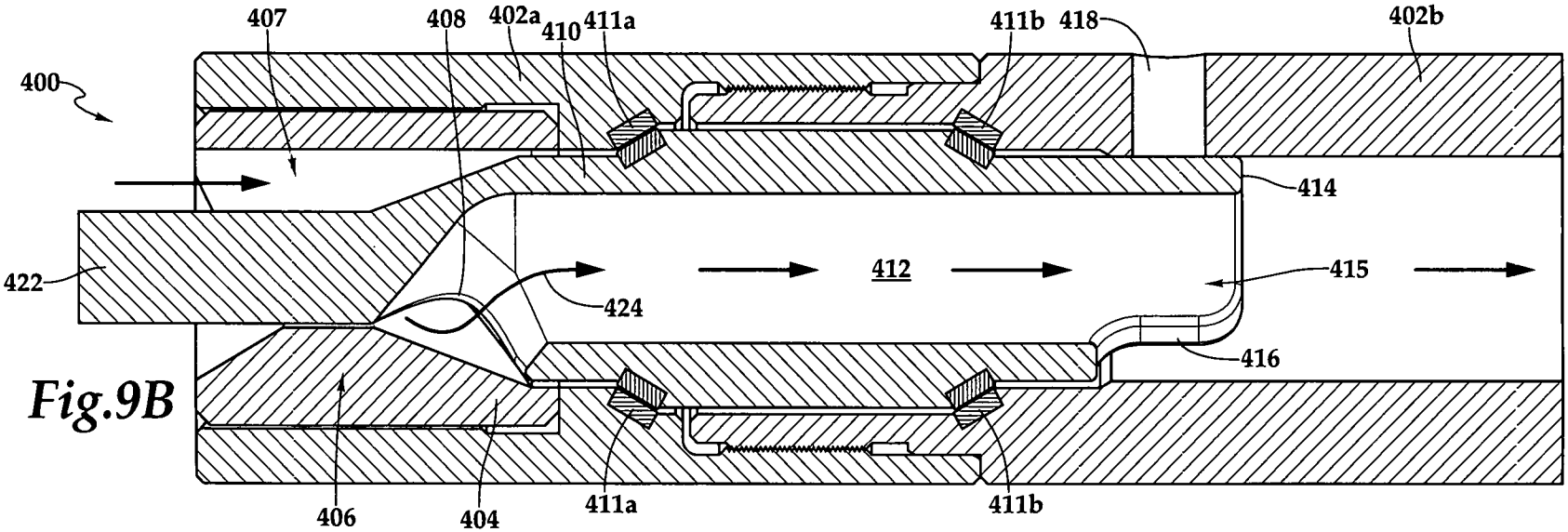

FIGS. 9A and 9B another example of an embodiment of a downhole tool 400 for creating cyclical pressure waves in drilling fluid for vibrating a drill string or coiled tubing. Like other embodiments, restricts and then opens an external vent while increasing the cross-sectional flow area for drilling fluid flowing through the tool to generate a pressure wave. The tool includes a tubular housing formed of two sections 402*a* and 402*b* that are connected together. In the subsequent description, reference number 402 will be used to designate the assembled housing. When the tool is installed in a drill string or connected with coiled tubing, drilling fluid will flow through a passageway through the housing. A sleeve 404, which has a step or partial collar shoulder 406, defines a flow area passage 407 for the drilling fluid into a hollow mandrill 410. The mandrill 410 is supported within the housing for rotation about its central axis by a two pairs bearings 411*a* and 411*b* that are oriented to prevent axial movement of the mandrill and transfer both radial and axial loads to the housing. The mandrill 410 has an upstream opening 408 to a conduit 412 formed through the mandrill to an opening 415 defined in the downstream end of the mandrill. Rotating the mandrill changes the orientation of the mandrill opening 408 with the passageway 407.

An external vent orifice 418 is defined through the housing at a location in which the mandrill 410 closes the external vent orifice 418 except when a slot 416 extending axially inwardly from the end of the mandrill, is aligned with the vent orifice 418. Opening the vent orifice allows drilling fluid to be externally vented to the annulus as indicated by arrow 420.

The mandrill 410 is rotated by a PDM, turbine, or other type of motor connected with coupling 422. Rotating the mandrill cycles the tool between an open state and a closed state shown in FIGS. 9A and 9B respectively. In the open state, the external vent orifice 418 is opened and the upstream opening 408 into the mandrill is aligned with the drilling fluid passageway 407 to create the widest or largest flow area for drilling fluid entering the mandrill. In the closed state, the external vent orifice 418 is closed and the upstream opening 408 is turned to occlude the passage 407. The size and shape of the opening 408 and the passageway 407 can be selected to allow drilling fluid flow when the flow area is at a minimum size, as indicated by arrows 424 in FIG. 9B.

Many of the components and parts reference can be, or are, made of multiple pieces. For example, a housing for a downhole tool can be made from multiple, tubular-shaped sections that are joined together, or from a single tubular-shaped piece of metal. Similarly, other components such as sleeves, mandrills, couplings can be assembled from multiple parts. Furthermore, a reference in the specification or in a claim to a single component or element does not foreclose embodiments with more than one of them or imply that an improvement is limited to just one, unless specifically stated or necessary. An external vent can be comprised of more than one opening, for example. A tool may have more than one vent. Describing a tool with a single vent with a single round orifice does not imply that the tool is limited to such a vent, as the principles disclosed allow for additional vents. Similarly, reference to a fluid passage does not preclude multiple fluid passageways through the tool. References to a single valve for controlling a vent or a bypass does not preclude, in other embodiments or examples, the same valve from being used to open and close multiple bypasses, or the possibility of using several valves to control communication to the same or multiple vents and bypasses, if the principles of operation of the embodiment do not otherwise foreclose it. Additionally, although vent orifice in the examples are round, they can be made in other shapes. The vents may include nozzles and features to improve seating of the element that cooperates with the vent to close it.

The foregoing are representative, non-limiting examples of downhole tools and methods of using them. Each example may embody several improvements, each of which might be separately claimed or claimed in different combinations. Furthermore, an example is not intended to limit of the scope of a claim to an improvement to the details of the example, as modifications can be made to the examples by those of ordinary skill in the art while still embodying a claimed improvement. The appended claims are not intended to be construed to be limited only to a specific example where their literal language permits a broader construction consistent with the specification set forth above.

What is claimed is:

1. A downhole tool for vibrating a drill string or coiled tubing to be lowered into a wellbore into which fluid under high pressure is being pumped, the tool comprising:

a tubular housing for connecting with the drill string or coiled tubing, the tubular housing having a central axis;

at least one fluid passageway within the tubular housing for communicating high pressure fluid between the ends of the tubular housing;

valving within the housing for cyclically venting high pressure fluid from the passageway to the exterior of the tubular housing through a vent in a side wall of the tubular housing, and increasing an effective cross-sectional flow area for the high pressure fluid flowing through the housing when venting high pressure fluid to decrease pressure of the high pressure fluid within the tool, and then decreasing the effective cross-sectional flow area to the pressure of the high pressure fluid within the tool without stopping the flow of high pressure fluid through the tool when not venting;

wherein the valving comprises a first valve mounted within the tubular housing for reciprocating, linear movement along the central axis between a first position that restricts communication of high pressure fluid through the vent and a second position that increases communication of high pressure fluid through the vent;

wherein the first valve comprises:

a non-rotating sleeve that slides in an axial direction within the tubular housing to block the vent, wherein the sleeve is moved in a linear, reciprocating motion by rotating cams positioned on opposite ends of the sleeve.

2. The downhole tool of claim 1, wherein the sleeve is reciprocated by alternating a pressure differential across the sleeve.

3. The downhole tool of claim 1, wherein the valving comprises a rotating valve.

4. The downhole tool of claim 3, further comprising a shaft with a hollow center comprising at least part of the passageway, wherein the rotating valve is rotated by the shaft.

5. The downhole tool of claim 4, wherein the valving further comprises an axial valve comprised of an axially reciprocating sleeve for controlling venting of the high pressure fluid through the vent that slides on the rotating shaft.

6. The downhole tool of claim 1, wherein the valving comprises a second valve for increasing an effective cross-sectional flow area for the high pressure fluid flowing through the housing when the first valve is open to vent high pressure fluid to decrease pressure of the high pressure fluid within the tool and then decreasing the effective cross-sectional flow area to the pressure of the high pressure fluid within the tool without stopping the flow of high pressure fluid through the tool when the first valve is closed.

7. The downhole tool of claim 6, wherein the second valve is comprised of a rotating valve.

8. The downhole tool of claim 1, further comprising:

a mandrill with a hollow center that comprises the at least one fluid passageway, the passageway hollow center having a restriction to narrow the effective cross-sectional flow area; and at least one port that is opened and closed to communicate high pressure fluid by reciprocating the mandrill axially within the housing to align the at least one port with a corresponding port for establishing fluid communication from the at least one fluid passageway and the vent and a fluid second passageway, the second fluid passageway enlarging the effective cross-sectional flow area of the high pressure fluid through the tool when opened.

9. A downhole tool comprising:

a tubular housing with a central axis for coupling with a drill string or coiled tubing, the tubular housing having hollow interior, an inlet opening and an outlet opening at opposite ends of the tubular housing through which high pressure fluid being pumped down a drill string or coiled tubing may pass, and a vent orifice formed in a sidewall of the tubular housing;

a high pressure fluid passageway within the tubular housing in fluid communication with the inlet and outlet openings and the vent orifice;

a non-rotating valve mounted within the tubular housing for reciprocating, linear translation along the central axis, the non-rotating valve restricting the vent orifice between a first position and a second position; and cams mounted for rotation within the tubular housing on opposite ends of the non-rotating valve, the cams engaging cam followers formed on the opposite ends of the linear, non-rotating valve to cause the reciprocating, linear translations of the valve as the cams are rotated.

10. The downhole tool of claim 9 wherein the non-rotating valve is comprised of a sleeve.

11. The downhole tool of claim 10, further comprising a rotary valve mounted within the housing for cyclically enlarging a cross-sectional flow area of the passageway.

12. The downhole tool of claim 11, wherein the cams and the rotary valve are coupled by a rotatable shaft extending along the central axis for synchronous rotation of the cams and rotary valves.

13. The downhole tool of claim 11, further comprising a rotatable shaft extending along the central axis, the shaft having a hollow center that comprises at least part of the passageway.

14. The downhole tool of 13, wherein the linear, non-rotating valve is comprised of a sleeve and the rotatable shaft extends through the open center of the sleeve.

15. The downhole tool of claim 13, wherein the shaft having a plurality of openings for communicating high pressure fluid to the vent orifice, at least one of which is not blocked by the sleeve when in the open position and at least one of which is not blocked by the sleeve in the closed position.

16. The downhole tool of claim 13, wherein, the rotatable shaft is hollow and at least partially defines the passageway, the rotatable shaft having at least one inlet opening at one end for receiving high pressure fluid, an outlet opening in an opposite end of the shaft for communicating high pressure fluid into a chamber, and a bypass opening through a side wall of the shaft; and the rotary valve comprises, a shoulder for blocking the bypass opening as the rotatable shaft rotates; and a bypass channel for communicating high pressure fluid to the chamber when the bypass opening is rotated into alignment with the bypass channel.

17. The downhole tool of claim 9, wherein the non-rotating valve and the rotary valve open and close at the same time.

18. The downhole tool of claim 9, wherein each of the cams has an axially eccentric end profile that forms a cam surface.

19. The downhole tool of claim 18, wherein the non-rotating valve is comprised of a sleeve having ends, each with an axially eccentric surface that comprises the cam follower.

* * * * *